US010201994B2

(12) United States Patent
Tsuchiya

(10) Patent No.: US 10,201,994 B2
(45) Date of Patent: Feb. 12, 2019

(54) INK JET PRINTER

(71) Applicant: MIMAKI ENGINEERING CO., LTD., Nagano (JP)

(72) Inventor: Atsushi Tsuchiya, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/682,551

(22) Filed: Aug. 22, 2017

(65) Prior Publication Data

US 2018/0056685 A1 Mar. 1, 2018

(30) Foreign Application Priority Data

Aug. 24, 2016 (JP) ..... 2016-163828

(51) Int. Cl.

| | |
|---|---|
| ***B41J 2/17*** | (2006.01) |
| ***B41J 29/377*** | (2006.01) |
| ***B41J 2/20*** | (2006.01) |
| ***B41J 29/13*** | (2006.01) |
| *B41J 2/165* | (2006.01) |
| *B41J 11/00* | (2006.01) |

(52) U.S. Cl.

CPC ..... *B41J 29/377* (2013.01); *B41J 2/1714* (2013.01); *B41J 2/20* (2013.01); *B41J 29/13* (2013.01); *B41J 2/1652* (2013.01); *B41J 11/002* (2013.01)

(58) Field of Classification Search

CPC ..... B41J 2/1714

See application file for complete search history.

(56) References Cited

U.S. PATENT DOCUMENTS

2012/0001991 A1* 1/2012 Onozawa ..... B41J 2/1714 347/102

2012/0113187 A1* 5/2012 Kiuchi ..... B41J 2/1714 347/30

FOREIGN PATENT DOCUMENTS

JP 2009-172937 8/2009

* cited by examiner

*Primary Examiner* — Jason S Uhlenhake

(74) *Attorney, Agent, or Firm* — JCIPRNET

(57) ABSTRACT

A head unit of an ink jet printer is formed with a mist removing space for removing an ink mist generated when an UV ink is discharged by an ink jet head from a gap between the head unit and a table, where the mist removing space is formed with a gas introducing port, arranged at a position between the ink jet head and the LED, for the gas to be introduced from the gap side between the head unit and the table to the mist removing space, an intake port for the gas to be suctioned from the mist removing space toward a sirocco fan side by an airflow generated by the sirocco fan, and a gas discharging port, arranged separately from the intake port, for the gas to be discharged from the mist removing space.

20 Claims, 15 Drawing Sheets

INK JET PRINTER

CROSS REFERENCE TO RELATED APPLICATIONS

This application claims the priority benefit of Japanese Patent Application No. 2016-163828, filed on Aug. 24, 2016. The entirety of the above-mentioned patent application is hereby incorporated by reference herein and made a part of this specification.

TECHNICAL FIELD

The present disclosure relates to an ink jet printer that executes printing by discharging ink toward a to-be-printed medium.

DESCRIPTION OF THE BACKGROUND ART

A printer including a medium supporting unit that supports a to-be-supported medium, a relative moving unit that is relatively moved with respect to the medium supporting unit, and an airflow generating unit that generates a flow of gas, that is, an airflow is conventionally known for an ink jet printer that executes printing by discharging the ink toward the to-be-printed medium (see e.g., Japanese Unexamined Patent Publication No. 2009-172937).

In the ink jet printer described in Japanese Unexamined Patent Publication No. 2009-172937, the relative moving unit is arranged with a gap between the relative moving unit and the medium supporting unit, and is relatively moved with respect to the medium supporting unit in an orthogonal direction of a first direction in which the relative moving unit exists with respect to the medium supporting unit.

Furthermore, the relative moving unit includes an ink discharging unit for discharging a light curing type ink, which cures when irradiated with light, toward the to-be-printed medium supported by the medium supporting unit, and a light irradiating unit for irradiating the light curing type ink on the to-be-printed medium supported by the medium supporting unit with light. The light irradiating unit exists with respect to the ink discharging unit in a second direction orthogonal to the first direction.

Moreover, in the ink jet printer described in Japanese Unexamined Patent Publication No. 2009-172937, the relative moving unit is formed with a mist removing space for removing an ink mist, generated when the light curing type ink is discharged by the ink discharging unit, from the gap between the medium supporting unit and the relative moving unit. The mist removing space is formed with a gas introducing port, arranged at a position between the ink discharging unit and the light irradiating unit, for the gas to be introduced from the gap side between the medium supporting unit and the relative moving unit to the mist removing space, and a gas suction port for the gas to be suctioned from the mist removing space toward the airflow generating unit side by the airflow generated by the airflow generating unit.

SUMMARY

However, in the ink jet printer described in Japanese Unexamined Patent Publication No. 2009-172937, when the ink mist, generated when the light curing type ink is discharged by the ink discharging unit, cannot be completely removed through the gas suction port from the mist removing space, the ink mist may enter the gap between the medium supporting unit and the relative moving unit from the mist removing space, and attach to the to-be-printed medium and the light irradiating unit. When the ink mist attaches to the to-be-printed medium, this means that the light curing type ink inappropriately attaches to the to-be-printed medium, and hence the accuracy of printing with respect to the to-be-printed medium lowers. Furthermore, when the ink mist attaches to the light irradiating unit, the light irradiating unit cannot appropriately emit light, and thus the accuracy of printing with respect to the to-be-printed medium lowers.

The present disclosure thus provides an ink jet printer capable of enhancing the accuracy of printing with respect to the to-be-printed medium compared to the conventional art.

An ink jet printer of the present disclosure includes a medium supporting unit that supports a to-be-printed medium; a relative moving unit that is relatively moved with respect to the medium supporting unit; and an airflow generating unit that generates a flow of gas; where the relative moving unit is arranged with a gap between the relative moving unit and the medium supporting unit, and is relatively moved with respect to the medium supporting unit in an orthogonal direction of a first direction, in which the relative moving unit exists with respect to the medium supporting unit; the relative moving unit includes an ink discharging unit that discharges a light curing type ink, which cures when irradiated with light, toward the to-be-printed medium supported by the medium supporting unit, and a light irradiating unit that irradiates the light curing type ink attached to the to-be-printed medium supported by the medium supporting unit with light; the light irradiating unit exists with respect to the ink discharging unit in a second direction orthogonal to the first direction; the relative moving unit is formed with a mist removing space for removing an ink mist, generated when the light curing type ink is discharged by the ink discharging unit, from the gap; the mist removing space is formed with a gas introducing port, arranged at a position between the ink discharging unit and the light irradiating unit, for the gas to be introduced from the gap side to the mist removing space, a gas suction port for the gas to be suctioned from the mist removing space toward the airflow generating unit side by the flow generated by the airflow generating unit, and a gas discharging port, arranged separately from the gas suction port, for the gas to be discharged from the mist removing space; and the gas suction port is communicated to a flow path of the gas from the gas introducing port to the gas discharging port.

According to such configuration, the ink jet printer of the present disclosure includes the gas discharging port for the gas to be discharged from the mist removing space separately from the gas suction port for the gas to be suctioned from the mist removing space toward the airflow generating unit side by the airflow generated by the airflow generating unit, and has the gas suction port communicating to the flow path of the gas from the gas introducing port to the gas discharging port, so that the ink mist generated when the light curing type ink is discharged by the ink discharging unit can be removed not only through the gas suction port but even through the gas discharging port from the mist removing space. Therefore, the ink jet printer of the present disclosure can reduce the possibility the ink mist will enter the gap between the medium supporting unit and the relative moving unit from the mist removing space and attach to the to-be-printed medium or the light irradiating unit, and can consequently enhance the accuracy of printing with respect to the to-be-printed medium compared to the conventional art.

Furthermore, in the ink jet printer of the present disclosure, at least one part of the gas discharging port may be formed in the first direction with respect to the mist removing space.

According to such configuration, the ink jet printer of the present disclosure discharges the ink mist from the mist removing space through the gas discharging port in the first direction with respect to the mist removing space, that is, in the direction away from the gap between the medium supporting unit and the relative moving unit, and thus can reduce the possibility the ink mist discharged from the mist removing space through the gas discharging port will attach to the to-be-printed medium or the light irradiating unit, and can consequently enhance the accuracy of printing with respect to the to-be-printed medium.

In the ink jet printer of the present disclosure, the gas suction port may be formed in the second direction with respect to the mist removing space.

According to such configuration, in the ink jet printer of the present disclosure, when the light curing type ink is discharged by the ink discharging unit and irradiated with light by the light irradiating unit while the relative moving unit is being relatively moved in the direction opposite the second direction with respect to the medium supporting unit, the gas in the mist removing space flows toward the gas suction port side formed in the second direction with respect to the mist removing space by the relative movement of the relative moving unit in the direction opposite the second direction with respect to the medium supporting unit, so that the ink mist can be efficiently removed though the gas suction port from the mist removing space. Therefore, the ink jet printer of the present disclosure can reduce the possibility the ink mist will enter the gap between the medium supporting unit and the relative moving unit from the mist removing space and attach to the to-be-printed medium or the light irradiating unit, and can consequently enhance the accuracy of printing with respect to the to-be-printed medium.

In the ink jet printer of the present disclosure, at least one part of the gas discharging port may be formed with respect to the mist removing space in a third direction orthogonal to both the first direction and the second direction.

According to such configuration, the ink jet printer of the present disclosure discharges the ink mist from the mist removing space through the gas discharging port in the third direction with respect to the mist removing space, that is, in the orthogonal direction of the direction the light irradiating unit exists with respect to the mist removing space, and thus can reduce the possibility the ink mist discharged from the mist removing space through the gas discharging port will attach to the light irradiating unit, and can consequently enhance the accuracy of printing with respect to the to-be-printed medium.

In the ink jet printer of the present disclosure, the mist removing space may include a space existing in the first direction with respect to a space connecting the gas introducing port and the gas suction port in a shortest manner.

According to such configuration, in the ink jet printer of the present disclosure, the volume of the mist removing space is large compared to the configuration in which the mist removing space does not include the space existing in the first direction with respect to the space connecting the gas introducing port and the gas suction port in a shortest manner, and hence the amount of ink mist that can be collected in the mist removing space can be increased, and as a result, the ink mist can be efficiently removed through the gas suction port and the gas discharging port from the mist removing space. Therefore, the ink jet printer of the present disclosure can reduce the possibility the ink mist will enter the gap between the medium supporting unit and the relative moving unit from the mist removing space and attach to the to-be-printed medium or the light irradiating unit, and can consequently enhance the accuracy of printing with respect to the to-be-printed medium.

The ink jet printer of the present disclosure may further include a heat dissipating unit for dissipating the heat generated by the light irradiating unit; where the heat dissipating unit may be arranged at a position cooled by the gas suctioned from the mist removing space by the flow generated by the airflow generating unit.

According to such configuration, the ink jet printer of the present disclosure not only removes the ink mist through the gas suction port from the mist removing space by the airflow generated by the airflow generating unit, but also cools the light irradiating unit, so that the performance of the light irradiating unit can be appropriately maintained by the cooling, and consequently, the accuracy of printing with respect to the to-be-printed medium can be enhanced.

In the ink jet printer of the present disclosure, the airflow generating unit may be a sirocco fan.

The airflow generation ability of the sirocco fan is less likely to lower even if it gets dirty, and the sirocco fan can generate a locally strong airflow. The ink jet printer of the present disclosure can suppress the lowering of the accuracy of printing with respect to the to-be-printed medium since the airflow generation ability of the sirocco fan is less likely to lower even if the sirocco fan gets dirty from the ink mist. Furthermore, when cooling the light irradiating unit with the airflow generated by the airflow generating unit, the ink jet printer of the present disclosure can generate a locally strong airflow with the sirocco fan, so that the airflow generated by the sirocco fan can be intensively impacted on the heat dissipating unit, thus efficiently cooling the light irradiating unit.

The ink jet printer of the present disclosure can enhance the accuracy of printing with respect to a to-be-printed medium compared to the conventional art.

DETAILED DESCRIPTION OF EMBODIMENTS

Hereinafter, one embodiment of the present disclosure will be described using the drawings.

First, a configuration of an ink jet printer according to the present embodiment will be described.

Figure 1:
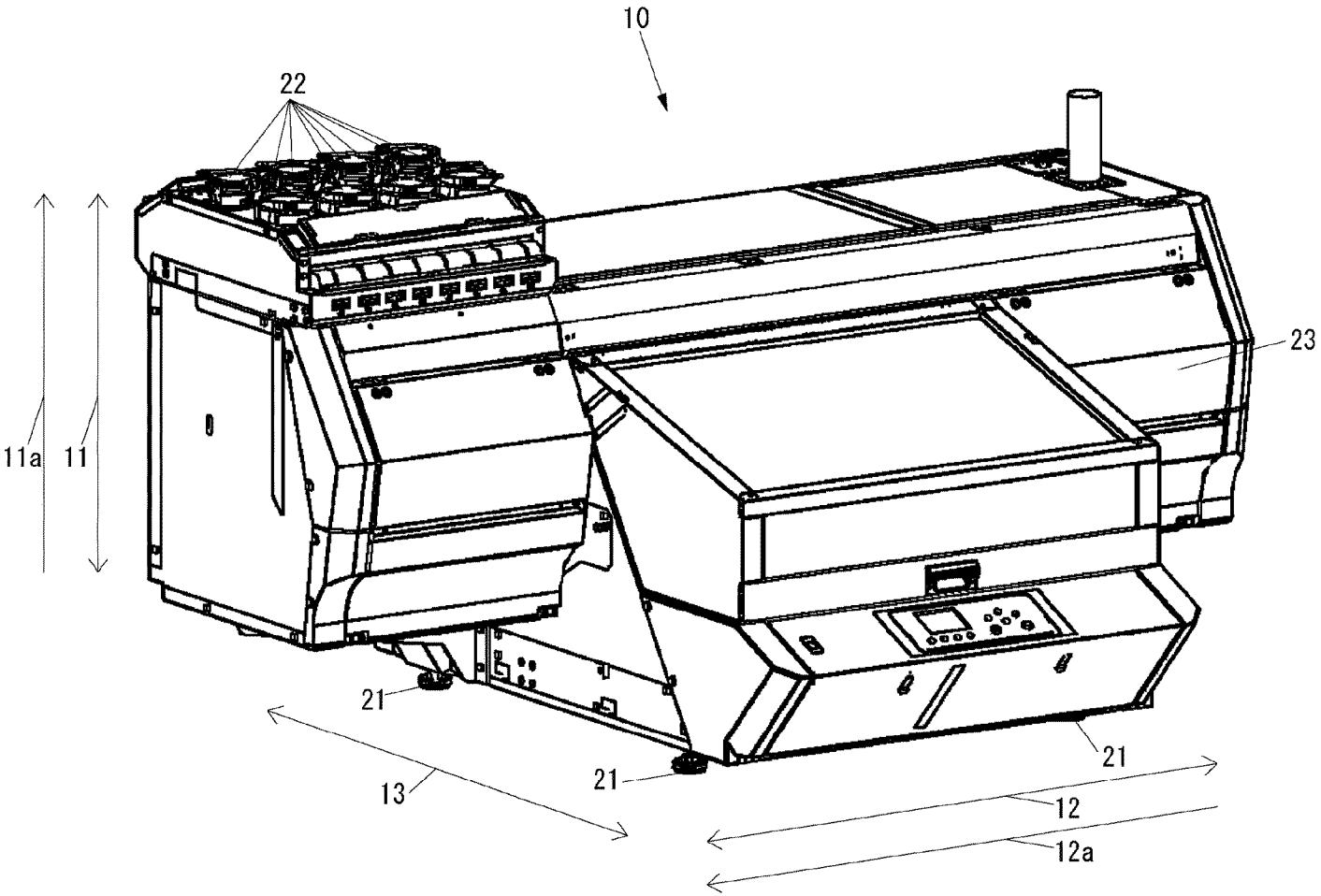
FIG. 1 is an outer appearance perspective view of when observed from an upper side of a left front side of an ink jet printer according to one embodiment of the present disclosure.

FIG. 1 is an outer appearance perspective view of when observed from an upper side of a left front side of an ink jet printer 10 according to the present embodiment.

As shown in FIG. 1, the ink jet printer 10 includes a leg 21 installed on a floor, a plurality of tanks 22 for storing an ultraviolet curing type ink (hereinafter referred to as "UV ink") serving as a light curing type ink that cures when irradiated with the ultraviolet ray, and a front cover 23 that covers the front surface of the ink jet printer 10.

Figure 2:
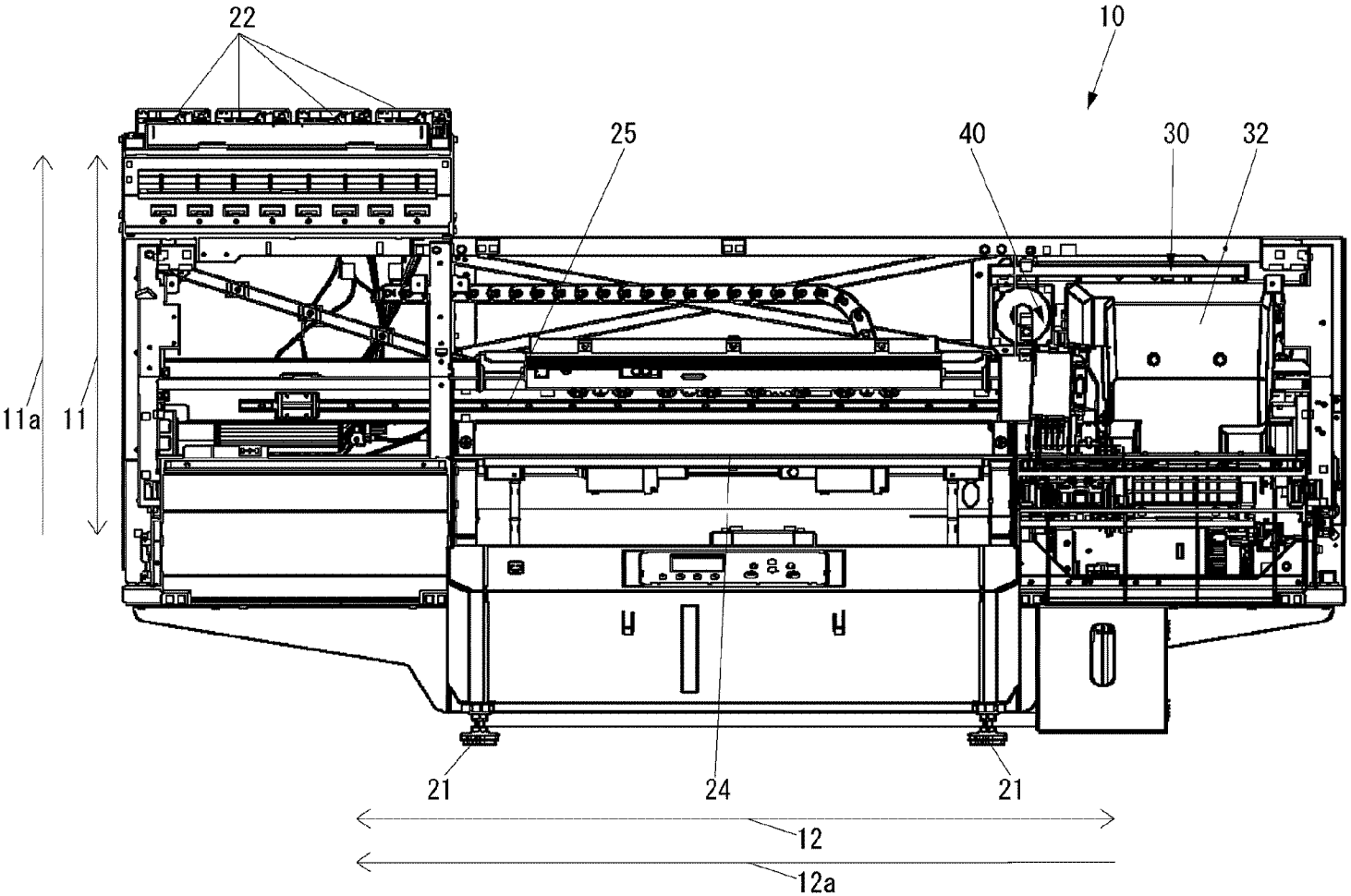
FIG. 2 is a front view of the ink jet printer shown in FIG. 1 with a front cover detached.

FIG. 2 is a front view of the ink jet printer 10 with the front cover 23 detached.

As shown in FIG. 2, the ink jet printer 10 includes a table 24 serving as a medium supporting unit that extends in an orthogonal direction of a vertical direction indicated with an arrow 11 and supports a to-be-printed medium, a guide rail 25 that extends in a main scanning direction indicated with an arrow 12, which is a left and right direction, of the ink jet printer 10 of the orthogonal direction of the vertical direction indicated with the arrow 11, and a head unit 30 serving as a relative moving unit that is supported by the guide rail 25 in a manner movable in the main scanning direction indicated with the arrow 12 and that is relatively moved with respect to the table 24.

Various objects such as a case for smartphone, a notebook, and the like, for example, can be adopted for the to-be-printed medium.

Figure 3:
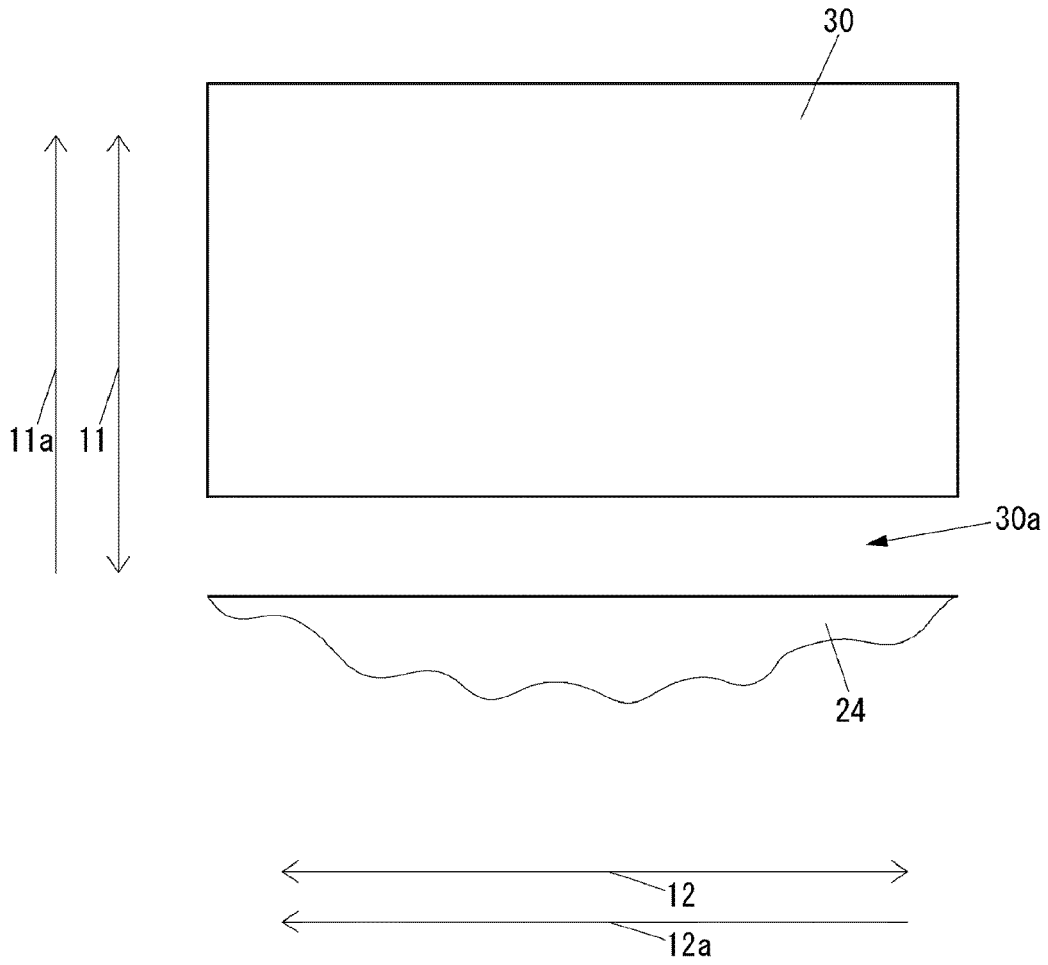
FIG. 3 is a schematic front view of a periphery of a head unit shown in FIG. 2.

FIG. 3 is a schematic front view of a periphery of the head unit 30.

As shown in FIG. 3, the head unit 30 is provided in a direction (first direction of the present disclosure) indicated with an arrow 11*a*, which is an upward direction in the vertical direction indicated with the arrow 11, with respect to the table 24, and is arranged with a gap 30*a* formed between the head unit 30 and the table 24. A distance of the gap 30*a* in the direction indicated with the arrow 11 is emphatically drawn long in FIG. 3, but is actually a very short distance of, for example, 1 mm to 1.5 mm, and the like.

Figure 4:
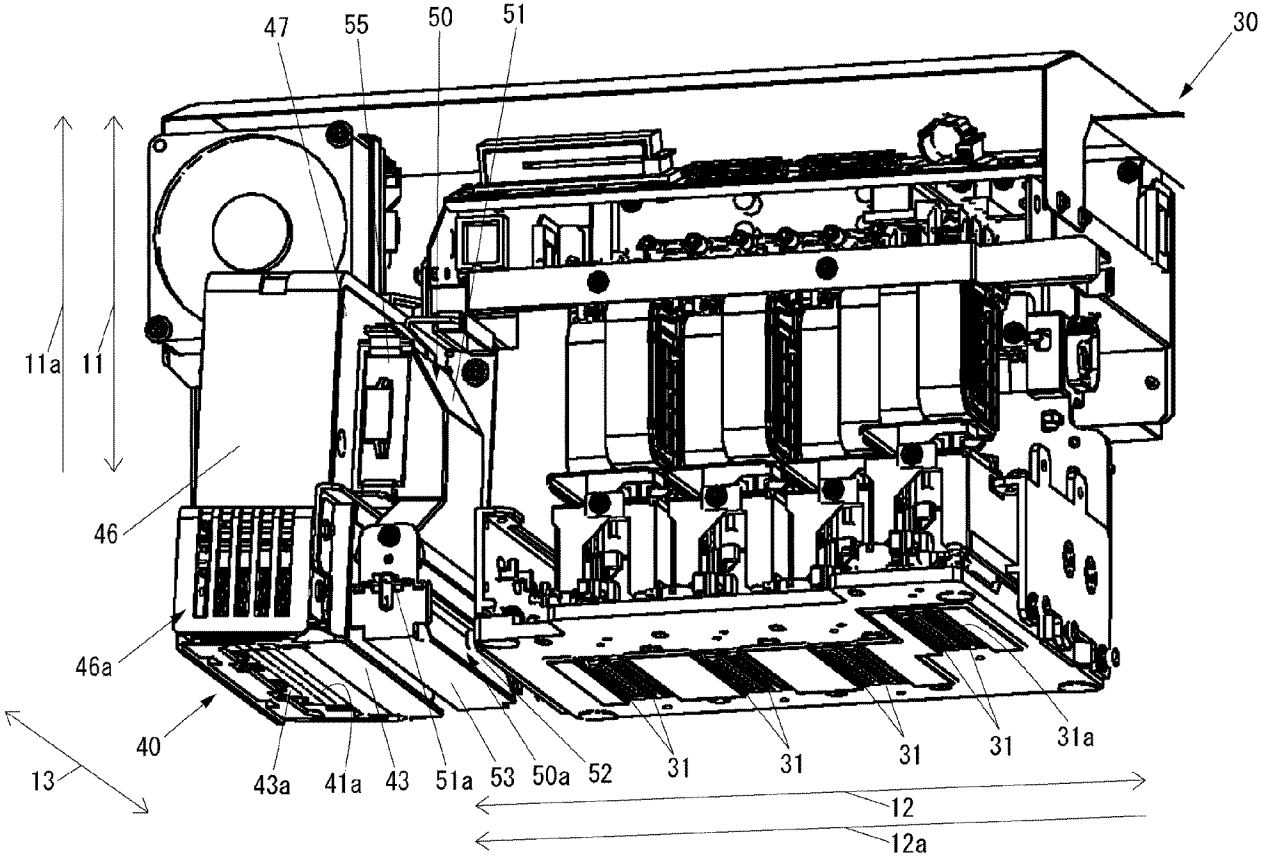
FIG. 4 is an outer appearance perspective view of when observed from a lower side of a right front side of the head unit shown in FIG. 2 with the cover detached.
Figure 5:
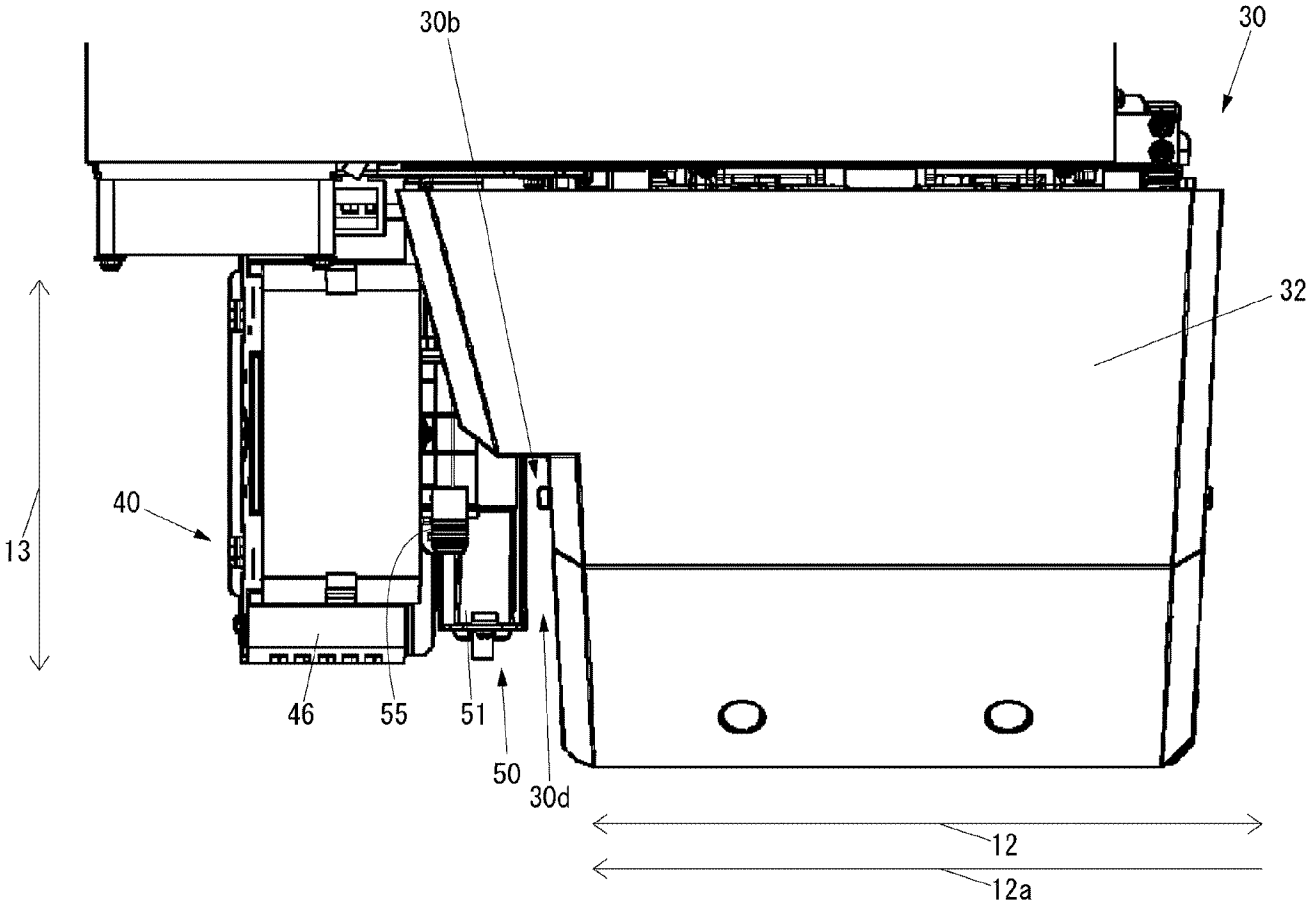
FIG. 5 is a top view of the head unit shown in FIG. 2.
Figure 6:
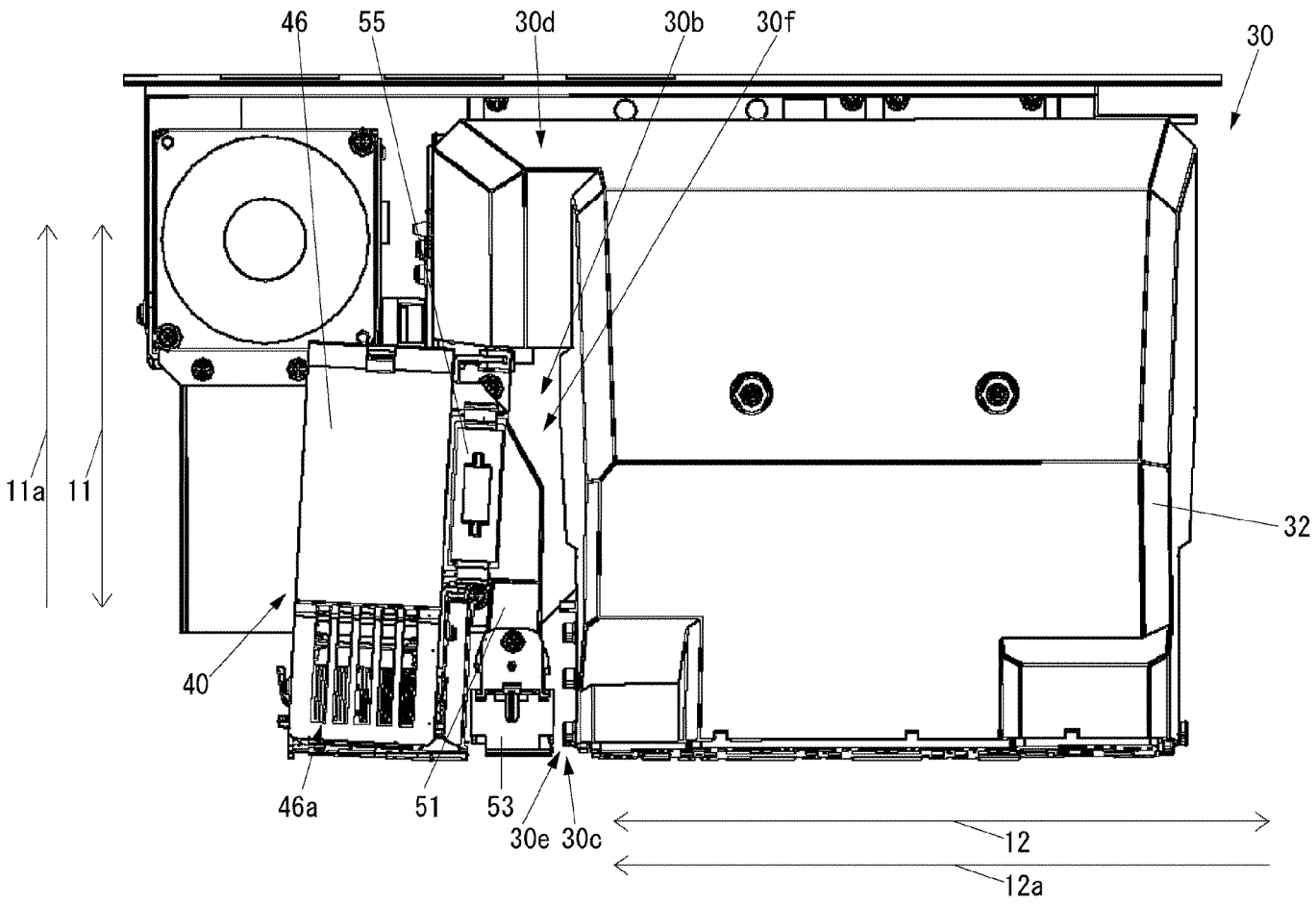
FIG. 6 is a front view of the head unit shown in FIG. 2.
Figure 7:
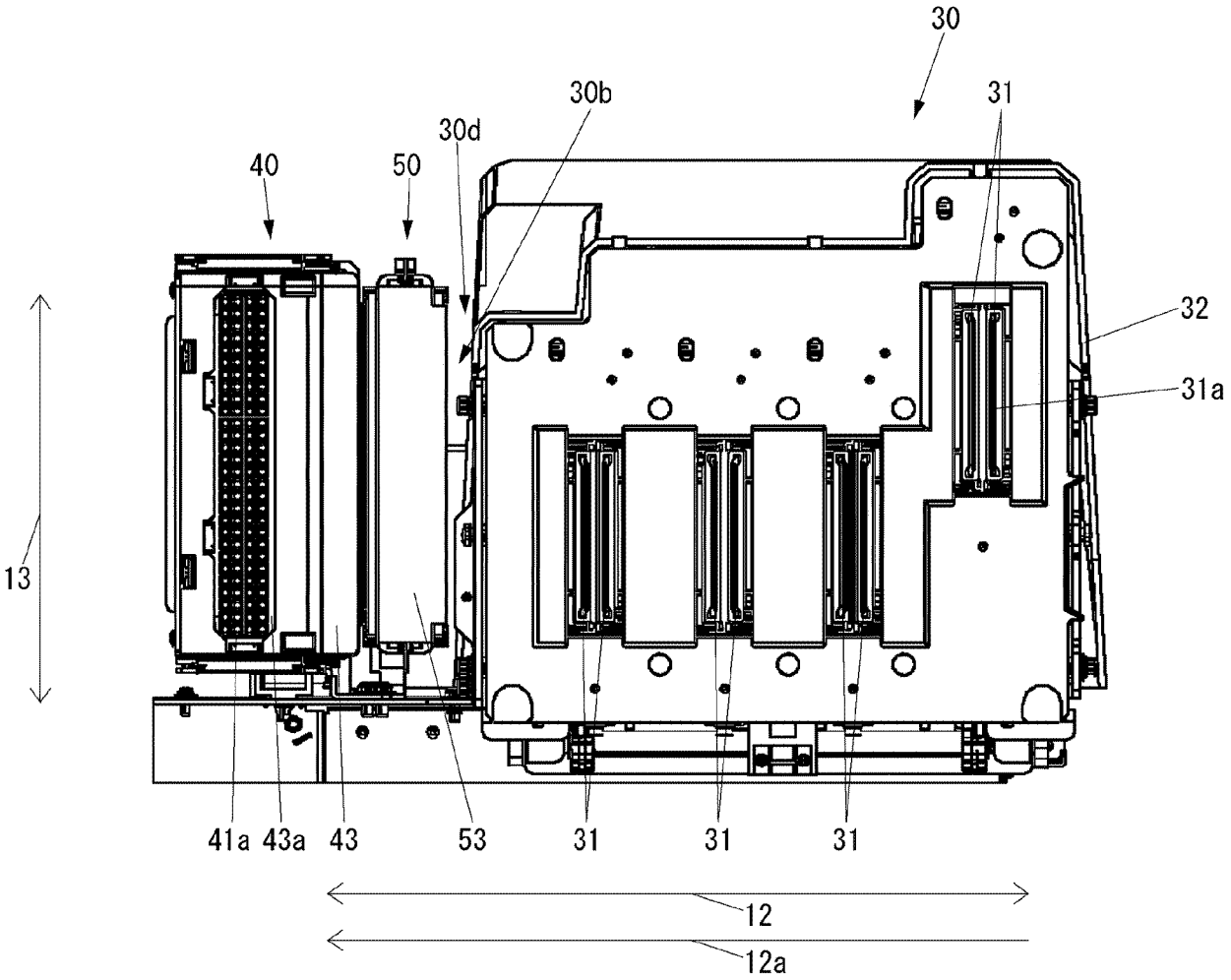
FIG. 7 is a bottom view of the head unit shown in FIG. 2.

FIG. 4 is an outer appearance perspective view of when observed from a lower side of a right front side of the head unit 30 with the cover 32 detached. FIG. 5 is a top view of the head unit 30. FIG. 6 is a front view of the head unit 30. FIG. 7 is a bottom view of the head unit 30.

As shown in FIGS. 4 to 7, the head unit 30 includes an ink jet head 31 serving as an ink discharging unit for discharging an UV ink toward the to-be-printed medium supported by the table 24 (see FIG. 2), the cover 32 that covers the front surface and the upper surface of the plurality of ink jet heads 31, and a UV unit 40 for irradiating the UV ink on the to-be-printed medium supported by the table 24 with an ultraviolet ray.

The UV ink is supplied from the tank 22 to the ink jet head 31 through a tube (not shown). The ink jet head 31 is formed with a nozzle row 31*a* in which a plurality of nozzles for discharging the UV ink are lined. The nozzle row 31*a* is extended in a sub-scanning direction (third direction of the present disclosure) indicated with an arrow 13, which is a front and back direction of the ink jet printer 10, of the orthogonal direction of the vertical direction indicated with the arrow 11.

The color of the UV ink discharged by the ink jet head 31 is, for example, yellow, magenta, cyan, black, light cyan, light magenta, white, and clear in order from the ink jet head 31 at the left end to the ink jet head 31 at the right end in FIG. 7.

As shown in FIGS. 5 to 7, the head unit 30 is formed with a mist removing space 30*b* for removing the ink mist, generated when the UV ink is discharged by the ink jet head 31, from the gap 30*a* (see FIG. 3).

The mist removing space 30*b* is formed with a gas introducing port 30*c* for the gas to be introduced from the gap 30*a* side to the mist removing space 30*b*, an intake port 50*a* (see FIG. 4) serving as a gas suction port for the gas to be suctioned from the mist removing space 30*b* toward a sirocco fan 44 side by the airflow generated by the sirocco fan 44 (see FIG. 9), to be described later, and a gas discharging port 30*d*, provided separately from the intake port 50*a*, for the gas to be discharged from the mist removing space 30*b*. The mist removing space 30*b* includes a space 30*f* extending in the direction indicated with the arrow 11*a* with respect to a space 30*e* that connects the air introducing port 30*c* and the intake port 50*a* in a shortest manner.

The gas introducing port 30*c* is disposed at a position between the ink jet head 31 and an LED (Light Emitting Diode) 41*a*, to be described later.

The gas discharging port 30*d* has one part formed in the direction indicated with the arrow 11*a* with respect to the mist removing space 30*b*. The gas discharging port 30*d* has one part formed in the sub-scanning direction indicated with the arrow 13 with respect to the mist removing space 30*b*.

Figure 8:
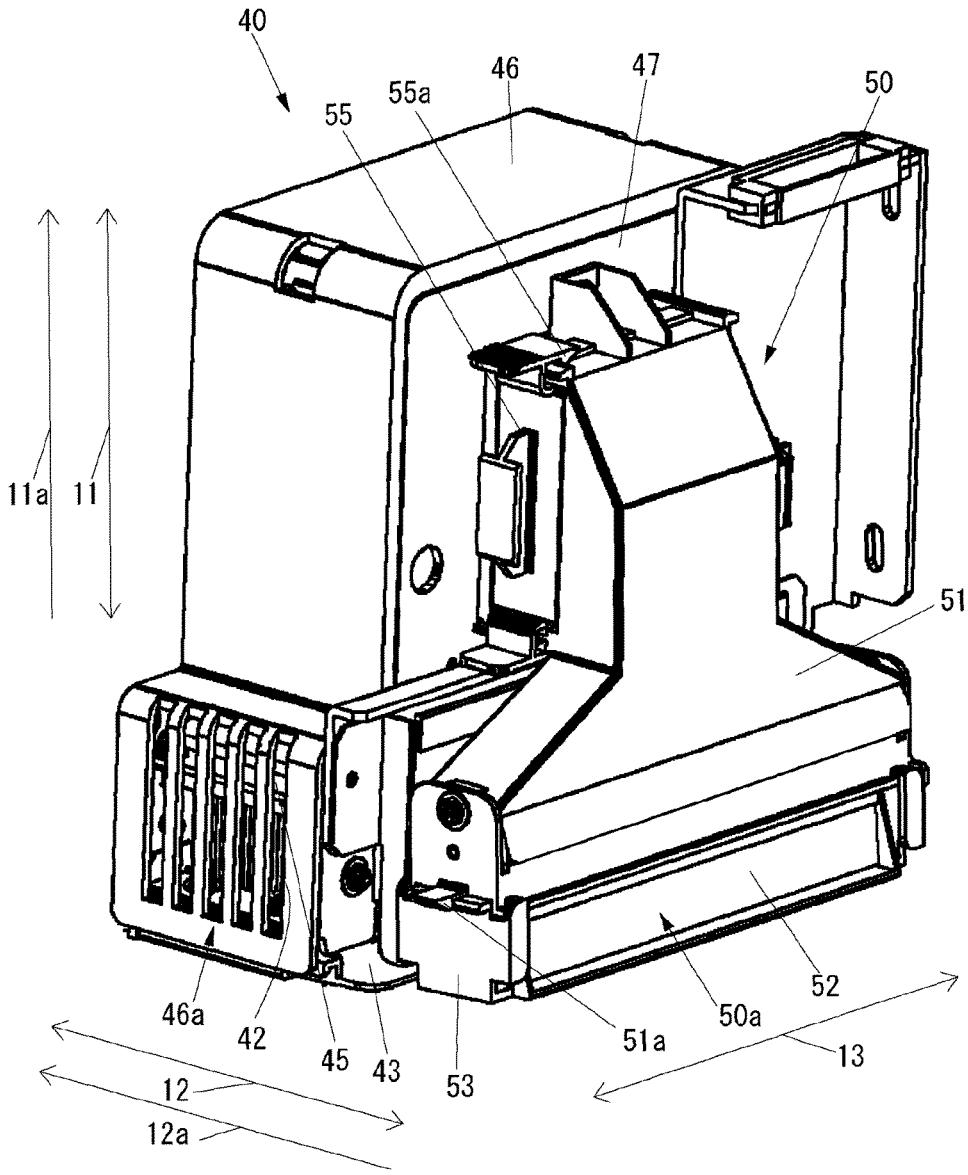
FIG. 8 is an outer appearance perspective view of when observed from an upper side of a right front side of a UV unit shown in FIG. 4.
Figure 9:
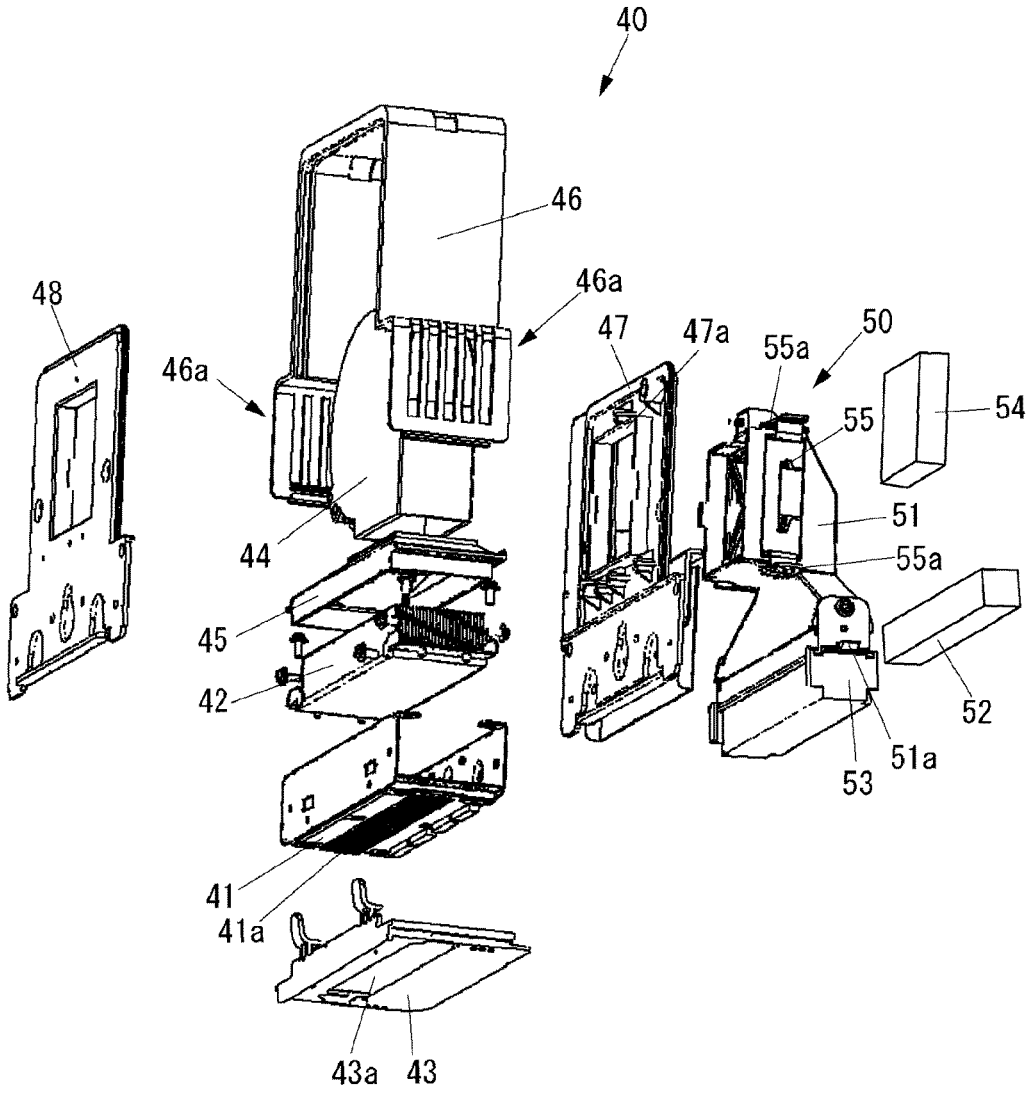
FIG. 9 is an exploded perspective view of the UV unit shown in FIG. 4.

FIG. 8 is an outer appearance perspective view of when observed from an upper side of a right front side of the UV unit 40. FIG. 9 is an exploded perspective view of the UV unit 40.

As shown in FIGS. 8 and 9, the UV unit 40 includes an LED substrate 41 with an LED 41*a* serving as a light irradiating unit for irradiating the UV ink on the to-be-printed medium supported by the table 24 (see FIG. 2) with the ultraviolet ray, a heat sink 42 serving as a heat dissipating unit for dissipating the heat generated by the LED substrate 41, and a glass holder 43 that fixes a glass 43*a* covering the LED 41*a*.

The LED 41*a* exists with respect to the ink jet head 31 (see FIG. 7) in a direction (second direction of the present disclosure) indicated with the arrow 12*a* of the main scanning direction indicated with the arrow 12.

The heat sink 42 has a plurality of plate-shaped fins extending in the orthogonal direction of the main scanning direction indicated with the arrow 12 (see FIG. 4) formed so as to be lined in the main scanning direction. The material of the heat sink 42 is, for example, aluminum. The heat sink 42 is disposed at a position cooled by the gas suctioned from the mist removing space 30*b* by the airflow generated by the sirocco fan 44, to be described later.

The glass 43*a* can prevent the UV ink from attaching to the LED 41*a*. Furthermore, the glass 43*a* can prevent the to-be-printed medium from making contact with and thus being burnt or combusted by the LED 41*a* that becomes a high temperature when the power is turned ON.

The UV unit 40 includes the sirocco fan 44 serving as a gas generating unit that generates a flow of gas, that is, an airflow; a duct 45 for guiding the gas discharged from the sirocco fan 44 to portions between the fins of the heat sink 42; a cover 46 that covers the sirocco fan 44, the cover having an exhaust port 46*a* for discharging the gas passed between the fins of the heat sink 42 formed on both sides in the sub-scanning direction indicated with the arrow 13; a cover 47 that covers the sirocco fan 44 from the right side of the sirocco fan 44, the cover 47 being formed with a hole 47*a* through which one part of a duct 50, to be described later, is inserted; a cover 48 that covers the sirocco fan 44 from the left side of the sirocco fan 44, and the duct 50 for guiding the gas from the intake port 50*a* to the sirocco fan 44, the duct 50 being formed with the intake port 50*a* for suctioning the gas.

The intake port 50*a* is formed in the direction indicated with the arrow 12*a* with respect to the mist removing space 30*b* (see FIG. 6). The intake port 50*a* is communicated to a flow path of the gas from the gas introducing port 30*c* (see FIG. 6) to the gas discharging port 30*d*.

The duct 50 includes a main body 51, a filter 52 disposed on the intake side in the duct 50, a filter case 53 that accommodates the filter 52, the filter case 53 being removable with respect to the main body 51 from the front surface of the ink jet printer 10, a filter 54 disposed on the exhaust side in the duct 50, and a filter case 55 that accommodates the filter 54, the filter case 55 being removable with respect to the main body 51 from the front surface of the ink jet printer 10.

The main body 51 is formed with a pawl 51*a* for fixing the filter case 53 with respect to the main body 51 by hooking to the filter case 53. The filter case 53 can be detached from the main body 51 by unhooking the pawl 51*a* from the filter case 53. The filter 52 can be replaced when the filter case 53 is detached from the main body 51.

The filter case 55 is formed with a pawl 55*a* for fixing the filter case 55 with respect to the main body 51 by hooking to the main body 51. The filter case 55 can be detached from the main body 51 by unhooking the pawl 55*a* from the main body 51. The filter 54 can be replaced when the filter case 55 is detached from the main body 51.

Figure 10:
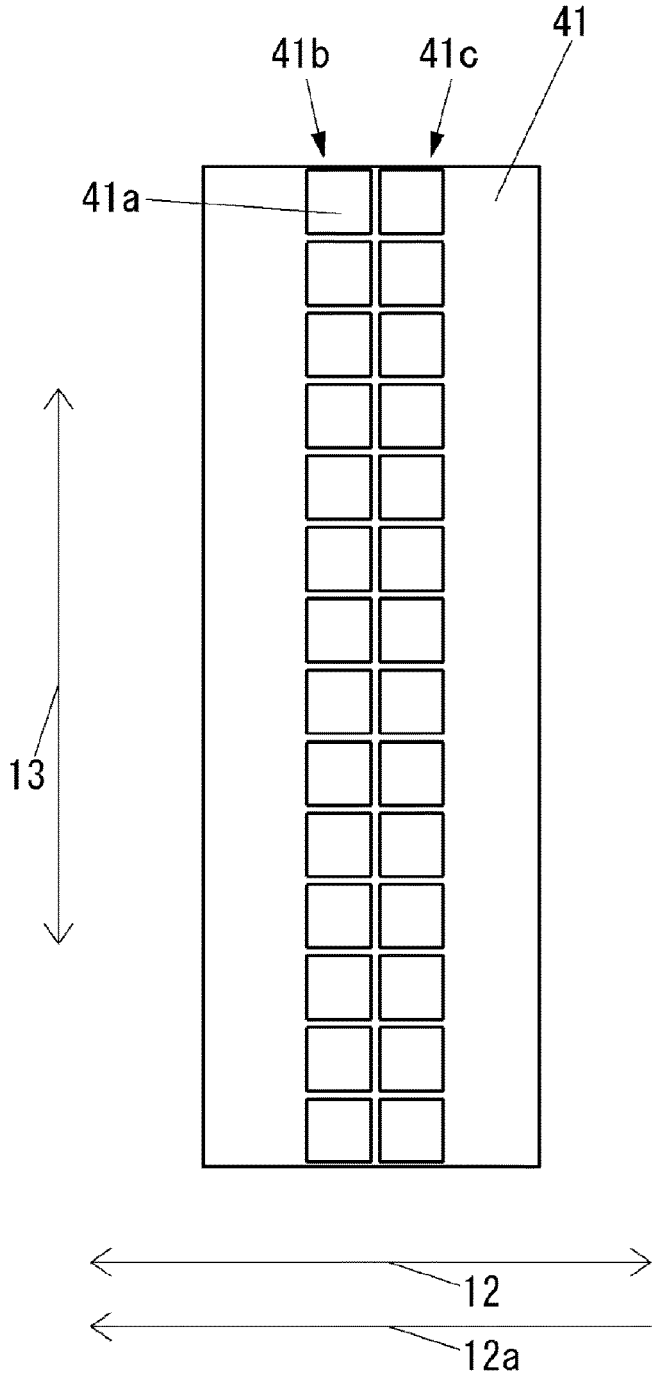
FIG. 10 is a bottom view of an LED substrate shown in FIG. 9.

FIG. 10 is a bottom view of the LED substrate 41.

As shown in FIG. 10, the LED substrate 41 has a row 41*b* of 14 LEDs 41*a*, which are lined in the sub-scanning direction indicated with the arrow 13, and a row 41*c* of 14 LEDs 41*a*, which are lined in the sub-scanning direction, lined in the main scanning direction indicated with the arrow 12.

The row 41*b* is disposed far from the ink jet head 31 (see FIG. 7) compared to the row 41*c*. The LED 41*a* belonging to the row 41*b* has high intensity of the output of the ultraviolet ray at the same power compared to the LED 41*a* belonging to the row 41*c*. The 14 LEDs 41*a* belonging to the row 41*b* all have the same property. Similarly, the 14 LEDs 41*a* belonging to the row 41*c* all have the same property.

The LED substrate 41 can control ON/OFF for every LED 41*a*. Furthermore, the LED substrate 41 can change the intensity of the output of the ultraviolet ray even for the same LED 41*a* by changing the magnitude of the power to supply to the LED 41*a*.

Figure 11:
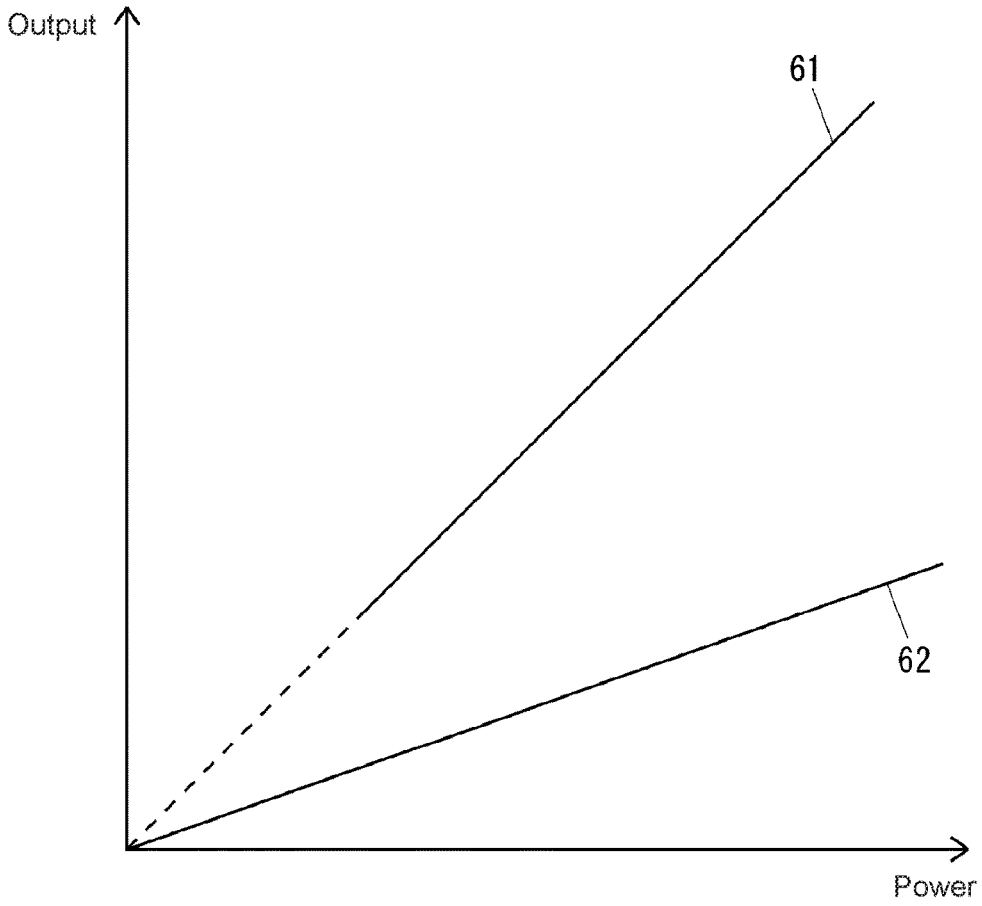
FIG. 11 is a view showing one example of an intensity of an output of an ultraviolet ray by the LED shown in FIG. 10.

FIG. 11 is a view showing one example of an intensity of an output of an ultraviolet ray by the LED 41*a*.

In FIG. 11, a graph 61 shows the intensity of the output of the ultraviolet ray by the LED 41*a* belonging to the row 41*b*. The LED 41*a* belonging to the row 41*b* can stably output the ultraviolet ray in a range the intensity of the output is strong, as shown with a solid line in the graph 61, but cannot stably output the ultraviolet ray in a range the intensity of the output is weak, as shown with a broken line in the graph 61. A graph 62 shows the intensity of the output of the ultraviolet ray by the LED 41*a* belonging to the row 41*c*. The LED 41*a* belonging to the row 41*c* can stably output the ultraviolet ray in a range the intensity of the output is weak, as shown in the graph 62, but cannot output the ultraviolet ray in which the intensity of the output is strong.

Figure 12:
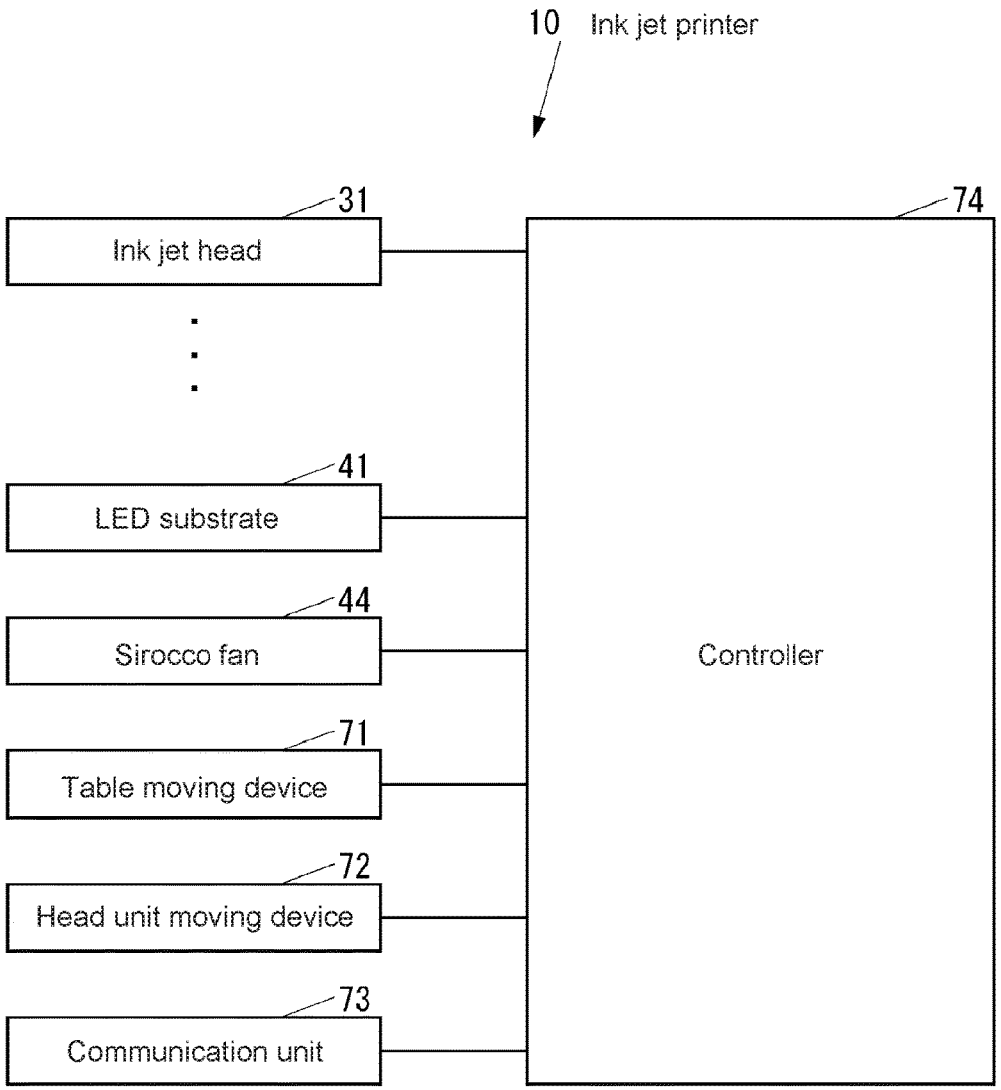
FIG. 12 is a block diagram of the ink jet printer shown in FIG. 1.

FIG. 12 is a block diagram of the ink jet printer 10.

As shown in FIG. 12, the ink jet printer 10 includes a table moving device 71 that moves the table 24 in the sub-scanning direction indicated with the arrow 13 (see FIG. 1) with respect to the head unit 30 (see FIG. 2), a head unit moving device 72 that moves the head unit 30 in the main scanning direction indicated with the arrow 12 (see FIG. 1) with respect to the table 24, a communication unit 73 or a communication device that carries out communication with an external device directly in a wired or wireless manner without through a network such as a LAN (Local Area Network) and the like or through the network, and a controller 74 that controls the entire ink jet printer 10.

The controller 74 includes, for example, a CPU (Central Processing Unit), a ROM (Read Only Memory) storing programs and various types of data in advance, and a RAM (Random Access Memory) used as a work region of the CPU. The CPU executes the program stored in the ROM.

Next, an operation of the ink jet printer 10 will be described.

The controller 74 controls the ink jet head 31, the LED substrate 41, the table moving device 71, and the head unit moving device 72 based on the print data input through the communication unit 73. Specifically, the controller 74 discharges the UV ink toward the to-be-printed medium on the table 24 and attaches the UV ink to the to-be-printed medium by the ink jet head 31 and irradiates the UV ink on the to-be-printed medium on the table 24 with the ultraviolet ray from the LED 41*a* of the LED substrate 41 to cure the UV ink while moving the head unit 30 in a direction opposite the direction indicated with the arrow 12*a* in the main scanning direction indicated with the arrow 12 with the head unit moving device 72 every time the position of the table 24 in the sub-scanning direction indicated with the arrow 13 is changed with respect to the head unit 30 by the table moving device 71, so that the image based on the print data is formed by the UV ink on the to-be-printed medium.

The controller 74 can adopt various irradiation patterns for the irradiation of the ultraviolet ray by the LED 41*a*.

For example, the controller 74 may execute the attachment of the UV ink on the to-be-printed medium by the ink jet head 31, the irradiation of the ultraviolet ray by the LED 41*a* belonging to the row 41*c* with respect to the UV ink, and the irradiation of the ultraviolet ray by the LED 41*a* belonging to the row 41*b* with respect to the UV ink in one movement of the head unit 30 in the direction opposite the direction indicated with the arrow 12*a* by the head unit moving device 72. The controller 74 then supplies power of the same magnitude to the LED 41*a* belonging to the row 41*c* and the LED 41*a* belonging to the row 41*b*. Therefore, the UV ink attached to the to-be-printed medium by the ink jet head 31 is irradiated with the ultraviolet ray in which the intensity of the output is weak by the LED 41*a* belonging to the row 41*c* immediately thereafter, and then irradiated with the ultraviolet ray in which the intensity of the output is strong by the LED 41*a* belonging to the row 41*b* immediately thereafter. For example, the clear UV ink tends to easily produce wrinkles when cured at once with the ultraviolet ray in which the intensity of the output is strong, but can suppress the production of wrinkles by being gradually cured with the ultraviolet ray in which the intensity of the output is weak, and then officially cured with the ultraviolet ray in which the intensity of the output is strong. Furthermore, the white UV ink tends to turn yellow when cured at once with the ultraviolet ray in which the intensity of the output is strong, but can suppress the yellowing by being gradually cured with the ultraviolet ray in which the intensity of the output is weak, and then officially cured with the ultraviolet ray in which the intensity of the output is strong.

Furthermore, the controller 74 may execute the attachment of the UV ink on the to-be-printed medium by the ink jet head 31 and at least one of the irradiation of the ultraviolet ray by the LED 41*a* belonging to the row 41*c* with respect to the UV ink and the irradiation of the ultraviolet ray by the LED 41*a* belonging to the row 41*b* with respect to the UV ink, in the movement of different times of the head unit 30 in the sub-scanning direction indicated with the arrow 12 by the head unit moving device 72.

When executing either the discharging of the UV ink by the ink jet head 31 or the irradiation of the ultraviolet ray by the LED 41*a* of the LED substrate 41, the controller 74 generates the airflow by the sirocco fan 44.

Figure 13:
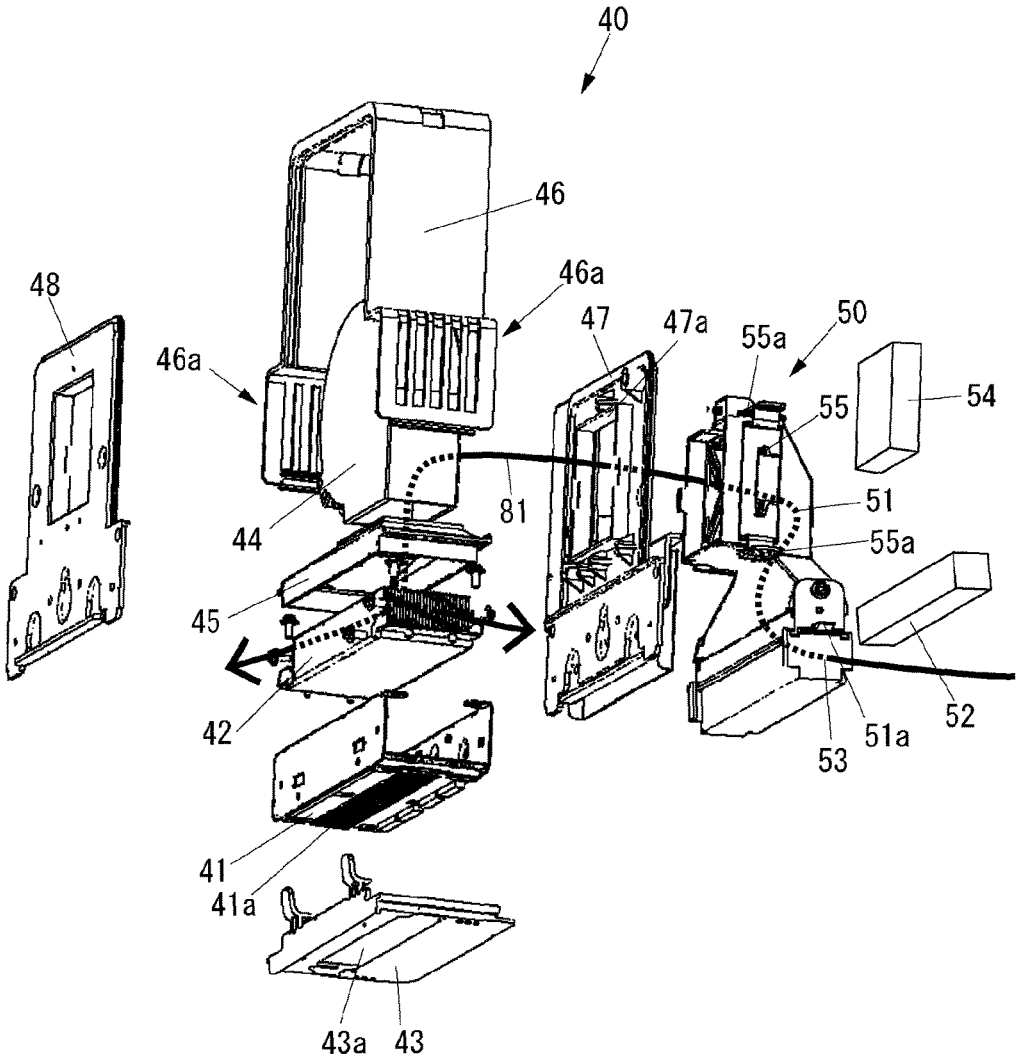
FIG. 13 is an exploded perspective view of the UV unit shown in FIG. 9 showing an airflow.

FIG. 13 is an exploded perspective view of the UV unit 40 showing the airflow.

When the sirocco fan 44 generates the airflow, the gas is introduced into the duct 50 from the intake port 50*a* (see FIG. 4), as shown with an arrow 81 in FIG. 13, and impurities such as the ink mist of the UV ink are removed with the filter 52. The gas that passed the filter 52 reaches the sirocco fan 44 after the still remaining impurities such as the ink mist are removed with the filter 54. Then, the gas that passed the sirocco fan 44 is passed through the duct 45 and between the fins of the heat sink 42, and then discharged from the exhaust port 46*a* of the cover 46.

The ink mist generated when the UV ink is discharged by the ink jet head 31 is introduced into the mist removing space 30*b* with the gas from the gas introducing port 30*c* existing in the direction indicated with the arrow 12*a* with respect to the ink jet head 31 by the movement of the head unit 30 in the direction opposite the direction indicated with the arrow 12*a*. The ink mist introduced with the gas to the mist removing space 30*b* has one part taken into the UV unit 40 from the intake port 50*a* and removed from the gas by the filter 52 or the filter 54, and the remaining part discharged to the outside of the mist removing space 30*b* from the gas discharging port 30*d*.

As described above, the ink jet printer 10 includes the gas discharging port 30*d* for the gas to be discharged from the mist removing space 30*b*, separately from the intake port 50*a* for the gas to be suctioned toward the sirocco fan 44 side from the mist removing space 30*b* by the airflow generated by the sirocco fan 44, and has the intake port 50*a* communicating to the flow path of the gas from the gas introducing port 30*c* to the gas discharging port 30*d*, so that the ink mist generated when the UV ink is discharged by the ink jet head 31 can be removed not only through the intake port 50*a* but even through the gas discharging port 30*d* from the mist removing space 30*b*. Therefore, the ink jet printer 10 can reduce the possibility the ink mist will enter the gap 30*a* between the table 24 and the head unit 30 from the mist removing space 30*b* and attach to the to-be-printed medium or the LED 41*a*, and can consequently enhance the accuracy of printing with respect to the to-be-printed medium compared to the conventional art.

The ink jet printer 10 discharges the ink mist from the mist removing space 30*b* through the gas discharging port 30*d* in the direction indicated with the arrow 11*a* with respect to the mist removing space 30*b*, that is, in the direction away from the gap 30*a* between the table 24 and the head unit 30, and thus can reduce the possibility the ink mist discharged from the mist removing space 30*b* through the gas discharging port 30*d* will attach to the to-be-printed medium or the LED 41*a* and can consequently enhance the accuracy of printing with respect to the to-be-printed medium.

The gas discharging port 30*d* may not be provided in the direction indicated with the arrow 11*a* with respect to the mist removing space 30*b* as long as the gas discharging port is provided separately from the intake port 50*a*.

In the ink jet printer 10, when the UV ink is discharged by the ink jet head 31 and irradiated with the ultraviolet ray by the LED 41*a* while the head unit 30 is being relatively moved in the direction opposite the direction indicated with the arrow 12*a* with respect to the table 24, the gas in the mist removing space 30*b* flows toward the intake port 50*a* side formed in the direction indicated with the arrow 12*a* with respect to the mist removing space 30*b* by the relative movement of the head unit 30 in the direction opposite the direction indicated with the arrow 12*a* with respect to the table 24, so that the ink mist can be efficiently removed though the intake port 50*a* from the mist removing space 30*b*. Therefore, the ink jet printer 10 can reduce the possibility the ink mist will enter the gap 30*a* between the table 24 and the head unit 30 from the mist removing space 30*b* and attach to the to-be-printed medium or the LED 41*a*, and can consequently enhance the accuracy of printing with respect to the to-be-printed medium.

The ink jet printer 10 discharges the ink mist from the mist removing space 30*b* through the gas discharging port 30*d* in the sub-scanning direction indicated with the arrow 13 with respect to the mist removing space 30*b*, that is, the orthogonal direction of the direction in which the LED 41*a* exists with respect to the mist removing space 30*b*, and thus can reduce the possibility the ink mist discharged from the mist removing space 30*b* through the gas discharging port 30*d* will attach to the LED 41*a*, and can consequently, enhance the accuracy of printing with respect to the to-be-printed medium.

The gas discharging port 30*d* may not be provided in the sub-scanning direction indicated with the arrow 13 with respect to the mist removing space 30*b* as long as the gas discharging port is provided separately from the intake port 50*a*.

In the ink jet printer 10, the volume of the mist removing space 30*b* is large compared to the configuration in which the mist removing space 30*b* does not include the space 30*f* existing in the direction indicated with the arrow 11*a* with respect to the space 30*e* connecting the gas introducing port 30*c* and the intake port 50*a* in a shortest manner, and hence the amount of ink mist that can be collected in the mist removing space 30*b* can be increased, and as a result, the ink mist can be efficiently removed through the intake port 50*a* and the gas discharging port 30*d* from the mist removing space 30*b*. Therefore, the ink jet printer 10 can reduce the possibility the ink mist will enter the gap 30*a* between the table 24 and the head unit 30 from the mist removing space 30*b* and attach to the to-be-printed medium or the LED 41*a*, and can consequently enhance the accuracy of printing with respect to the to-be-printed medium.

Figure 14:
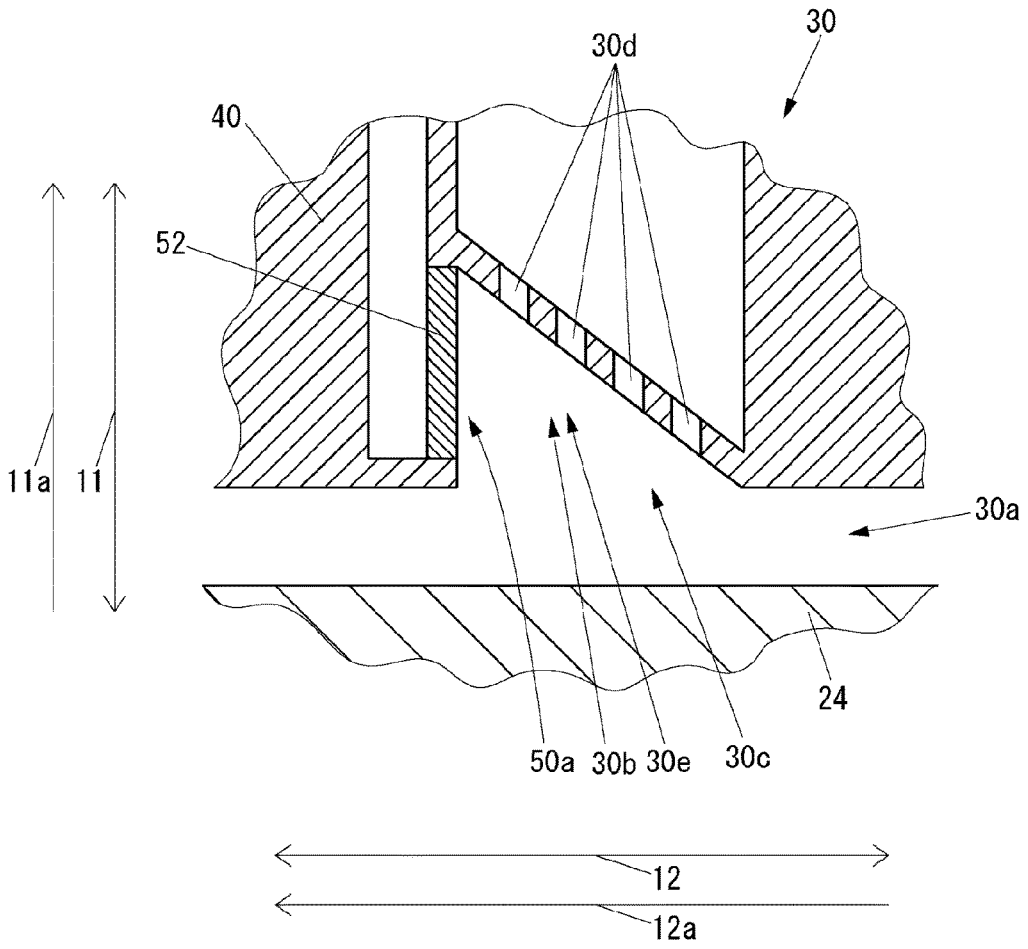
FIG. 14 is a view showing one example, different from the example shown in FIG. 6, of a mist removing space of the ink jet printer shown in FIG. 1.

As shown in FIG. 14, for example, the ink jet printer 10 may have a configuration in which the mist removing space 30*b* does not include the space existing in the direction indicated with the arrow 11*a* with respect to the space 30*e* connecting the gas introducing port 30*c* and the intake port 50*a* in the shortest manner. In the configuration shown in FIG. 14 as well, the ink mist is discharged from the mist removing space 30*b* through the gas discharging port 30*d* with the gas, but tends to easily accumulate in the mist removing space 30*b* as the ink mist is heavier than the gas. Therefore, in the configuration shown in FIG. 14, the ink jet printer 10 can suction the ink mist accumulated in the mist removing space 30*b* from the intake port 50*a* to the UV unit 40 along with the gas, and efficiently remove the ink mist from the gas with the filter 52 or the filter 54 (see FIG. 9).

Figure 15:
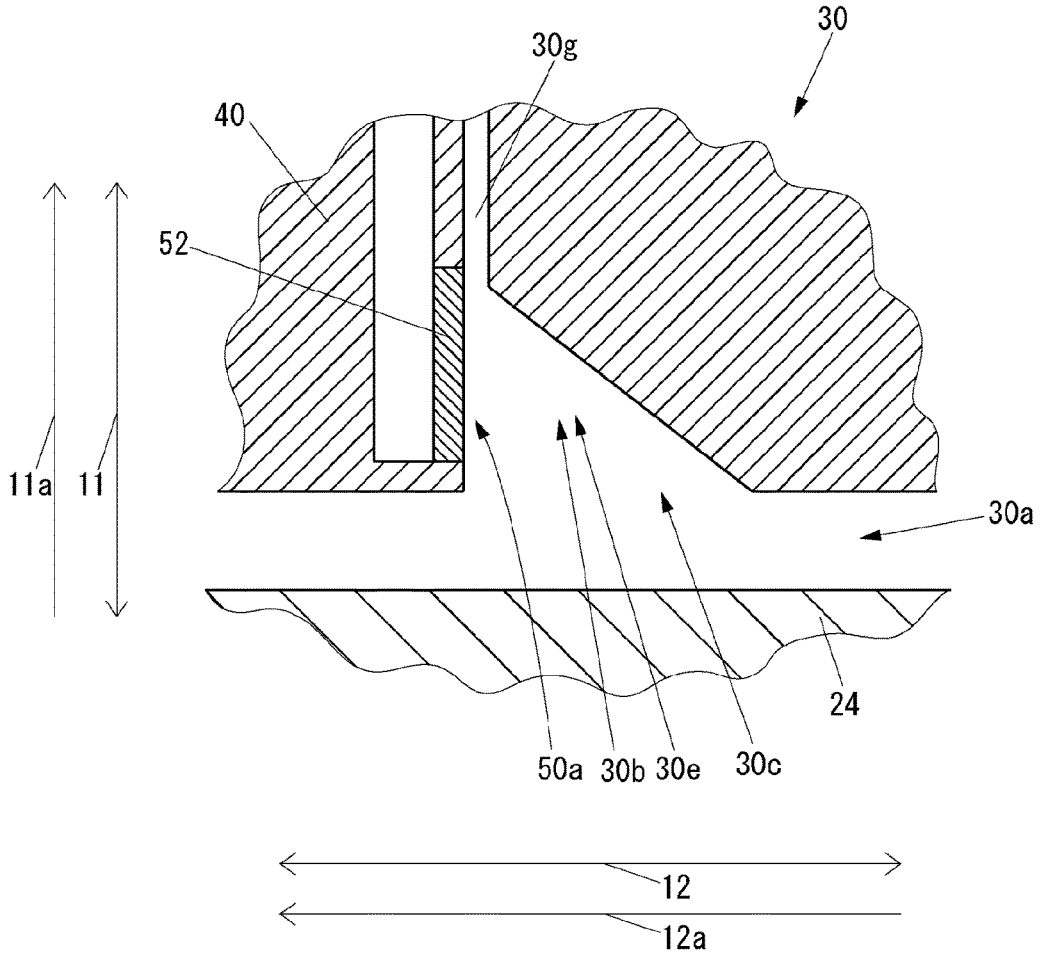
FIG. 15 is a view showing one example, different from the examples shown in FIGS. 6 and 14, of the mist removing space of the ink jet printer shown in FIG. 1.

The configuration of the mist removing space 30*b* may be a configuration other than the configuration described above. For example, as shown in FIG. 15, the mist removing space 30*b* may be formed with a space 30*g* that exists in the direction indicated with the arrow 11*a* with respect to the space 30*e* in the vicinity of the intake port 50*a*. The space 30*g* is a narrow space extending in the direction indicated with the arrow 11*a*.

The ink jet printer 10 not only removes the ink mist through the intake port 50*a* from the mist removing space 30*b* by the airflow generated by the sirocco fan 44, but also cools the LED 41*a*, so that the performance of the LED 41*a* can be appropriately maintained by the cooling, and consequently, the accuracy of printing with respect to the to-be-printed medium can be enhanced.

The airflow generation ability of the sirocco fan 44 is less likely to lower even if it gets dirty, and the sirocco fan can generate a locally strong airflow. The ink jet printer 10 can suppress the lowering of the accuracy of printing with respect to the to-be-printed medium since the airflow generation ability of the sirocco fan 44 is less likely to lower even if the sirocco fan 44 gets dirty from the ink mist. Furthermore, since a locally strong airflow can be generated by the sirocco fan 44, the ink jet printer 10 can intensively impact the airflow generated by the sirocco fan 44 to the heat sink 42 to efficiently cool the LED 41*a*. The airflow generating unit of the present disclosure may not be the sirocco fan. For example, the airflow generating unit of the present disclosure may be an axial flow fan.

The ink jet printer 10 includes the mist removing space 30*b* and the UV unit 40 only in the direction indicated with the arrow 12*a* with respect to the ink jet head 31. However, the ink jet printer 10 can execute printing with both the movement of the UV unit 40 in the direction indicated with the arrow 12*a* with respect to the table 24 and the movement of the UV unit 40 in the direction opposite the direction indicated with the arrow 12*a* with respect to the table 24 by disposing the mist removing space and the UV unit also in the direction opposite the direction indicated with the arrow 12*a* with respect to the ink jet head 31 in a manner symmetric to the mist removing space 30*b* and the UV unit 40.

What is claimed is:

1. An ink jet printer comprising:

a medium supporting unit that supports a to-be-printed medium;

a relative moving unit that is relatively moved with respect to the medium supporting unit; and an airflow generating unit that generates a flow of gas, wherein the relative moving unit is arranged with a gap between the relative moving unit and the medium supporting unit, and is relatively moved with respect to the medium supporting unit in an orthogonal direction of a first direction, in which the relative moving unit exists with respect to the medium supporting unit, the relative moving unit includes:

an ink discharging unit that discharges a light curing type ink, which cures when irradiated with light, toward the to-be-printed medium supported by the medium supporting unit; and a light irradiating unit that irradiates the light curing type ink attached to the to-be-printed medium supported by the medium supporting unit with light, wherein the light irradiating unit exists with respect to the ink discharging unit in a second direction orthogonal to the first direction, the relative moving unit is formed with a mist removing space for removing an ink mist, generated when the light curing type ink is discharged by the ink discharging unit, from the gap, the mist removing space is located between the ink discharging unit and the light irradiating unit in the second direction, the mist removing space is formed with a gas introducing port, arranged at a position between the ink discharging unit and the light irradiating unit, for the gas to be introduced from the gap side to the mist removing space;

a gas suction port for the gas to be suctioned from the mist removing space toward the airflow generating unit side by the flow generated by the airflow generating unit; and a gas discharging port, arranged separately from the gas suction port, for the gas suctioned by the gas suction port to be discharged from the mist removing space, wherein the gas suction port is communicated to a flow path of the gas from the gas introducing port to the gas discharging port, the gas introducing port, the gas discharging port and the mist removing space are communicated with one another, and the airflow generating unit is disposed between the gas suction port and the gas discharging port.

2. The ink jet printer according to claim 1, wherein at least one part of the gas discharging port is formed in the first direction with respect to the mist removing space.

3. The ink jet printer according to claim 2, wherein the mist removing space includes a space existing in the first direction with respect to a space connecting the gas introducing port and the gas suction port in a shortest manner.

4. The ink jet printer according to claim 3, further comprising a heat dissipating unit for dissipating a heat generated by the light irradiating unit; wherein the heat dissipating unit is arranged at a position cooled by the gas suctioned from the mist removing space by the flow generated by the airflow generating unit.

5. The ink jet printer according to claim 2, further comprising a heat dissipating unit for dissipating a heat generated by the light irradiating unit; wherein the heat dissipating unit is arranged at a position cooled by the gas suctioned from the mist removing space by the flow generated by the airflow generating unit.

6. The ink jet printer according to claim 2, wherein the airflow generating unit is a sirocco fan.

7. The ink jet printer according to claim 1, wherein the gas suction port is forming in the second direction with respect to the mist removing space.

8. The ink jet printer according to claim 7, wherein at least one part of the gas discharging port is formed with respect to the mist removing space in a third direction orthogonal to both the first direction and the second direction.

9. The ink jet printer according to claim 8, wherein the mist removing space includes a space existing in the first direction with respect to a space connecting the gas introducing port and the gas suction port in a shortest manner.

10. The ink jet printer according to claim 9, further comprising a heat dissipating unit for dissipating a heat generated by the light irradiating unit; wherein the heat dissipating unit is arranged at a position cooled by the gas suctioned from the mist removing space by the flow generated by the airflow generating unit.

11. The ink jet printer according to claim 7, wherein the mist removing space includes a space existing in the first direction with respect to a space connecting the gas introducing port and the gas suction port in a shortest manner.

12. The ink jet printer according to claim 11, further comprising a heat dissipating unit for dissipating a heat generated by the light irradiating unit; wherein the heat dissipating unit is arranged at a position cooled by the gas suctioned from the mist removing space by the flow generated by the airflow generating unit.

13. The ink jet printer according to claim 7, further comprising a heat dissipating unit for dissipating a heat generated by the light irradiating unit; wherein the heat dissipating unit is arranged at a position cooled by the gas suctioned from the mist removing space by the flow generated by the airflow generating unit.

14. The ink jet printer according to claim 7, wherein the airflow generating unit is a sirocco fan.

15. The ink jet printer according to claim 8, further comprising a heat dissipating unit for dissipating a heat generated by the light irradiating unit; wherein the heat dissipating unit is arranged at a position cooled by the gas suctioned from the mist removing space by the flow generated by the airflow generating unit.

16. The ink jet printer according to claim 8, wherein the airflow generating unit is a sirocco fan.

17. The ink jet printer according to claim 1, wherein the mist removing space includes a space existing in the first direction with respect to a space connecting the gas introducing port and the gas suction port in a shortest manner.

18. The ink jet printer according to claim 17, further comprising a heat dissipating unit for dissipating a heat generated by the light irradiating unit; wherein the heat dissipating unit is arranged at a position cooled by the gas suctioned from the mist removing space by the flow generated by the airflow generating unit.

19. The ink jet printer according to claim 1, further comprising a heat dissipating unit for dissipating a heat generated by the light irradiating unit; wherein the heat dissipating unit is arranged at a position cooled by the gas suctioned from the mist removing space by the flow generated by the airflow generating unit.

20. The ink jet printer according to claim 1, wherein the airflow generating unit is a sirocco fan.

* * * * *